United States Patent [19]

Steinhauer

[11] 4,206,445

[45] Jun. 3, 1980

[54] HANDLE FOR A SKI-STICK

[76] Inventor: Leon Steinhauer, 29, Rotenturmstrasse, A-1010 Vienna, Austria

[21] Appl. No.: 863,716

[22] Filed: Dec. 23, 1977

[30] Foreign Application Priority Data

Dec. 23, 1976 [AT] Austria ..... 9576/76

[51] Int. Cl.[2] ..... G08B 5/00; H63C 11/22

[52] U.S. Cl. ..... 340/321; 280/819; 362/109

[58] Field of Search ..... 340/321, 134; 363/72, 363/102, 109; 280/11.37

[56] References Cited

U.S. PATENT DOCUMENTS

| | | | |
|---|---|---|---|
| 2,469,944 | 5/1949 | Bauters | 362/72 X |
| 4,023,817 | 5/1977 | Lah et al. | 280/11.37 B |

FOREIGN PATENT DOCUMENTS

| | | |
|---|---|---|
| 305846 | 3/1973 | Austria . |
| 2200571 | 8/1972 | Fed. Rep. of Germany . |

*Primary Examiner*—Donald J. Yusko

*Attorney, Agent, or Firm*—Fleit & Jacobson

[57] ABSTRACT

A handle for a ski-stick having a light source optionally operable to emit visible warning signals by means of an electric circuit and a manually operable switch and capable of receiving an electric power source, where said light source is accommodated in the handle of the ski-stick as opposed to being located in the stick and visible through the wall thereof.

2 Claims, 3 Drawing Figures

HANDLE FOR A SKI-STICK

SUMMARY OF THE INVENTION

A handle for a ski-stick having a light source being accommodated in the handle and visible through the wall thereof.

The present invention relates to a ski-stick handle for a ski-stick having a light bulb optionally operable to emit visible warning signals by means of a circuit having a current source and a manually actuable switch.

The advantage of such a ski-stick is that the skier can indicate to a person skiing behind him any directional change which he intends to make to the left or right—thus preventing collisions on crowded ski slopes.

In German Offenlegungsschrift No. 2,200,571 it is proposed a light bulb be located in the interior of a tubular ski-stick shaft and that the rays therefrom be emitted through apertures in the shaft whilst said apertures are covered with transparent or translucent material. Such apertures, however, unfavourably weaken the wall of the shaft so that breaking of the shaft of the ski-stick may more likely occur during a fall which can thus result in injury to the skier.

This deficiency of such known ski-sticks is countered in accordance with the present invention in that in a ski-stick handle of the kind initially mentioned, the light source or lamp as a whole is mounted or accommodated in the ski-stick handle.

According to the present invention there is provided a handle for a ski-stick having a light source optionally operable to emit visible warning signals by means of an electric circuit and a manually operable switch and capable of receiving an electric power source, characterised by said light source being accommodated in the handle of the ski-stick.

In this ski-stick handle, light rays or beams are emitted from a transparent or translucent cover possibly forming a part of the handle wall, such as the upper end thereof.

Ski-stick handles constructed in accordance with the invention also provide in addition to the already apparent advantages, the possibility of installation thereof on old or existing ski-sticks in place of the conventional handles.

Switching of the light on and off is effected by a manually actuatable switch, and the control is such that a flashing light or a continuous light may be emitted. It is, however, also possible to form the switch in such a manner as to permit Morse signals to be transmitted, so that the handle may, in the case of an accident or other danger, be used to summon a rescue team, or may be used for general signalling such as for military purposes.

The invention will be described further, by way of example, with reference to the accompanying drawings, in which.

Figure 1:
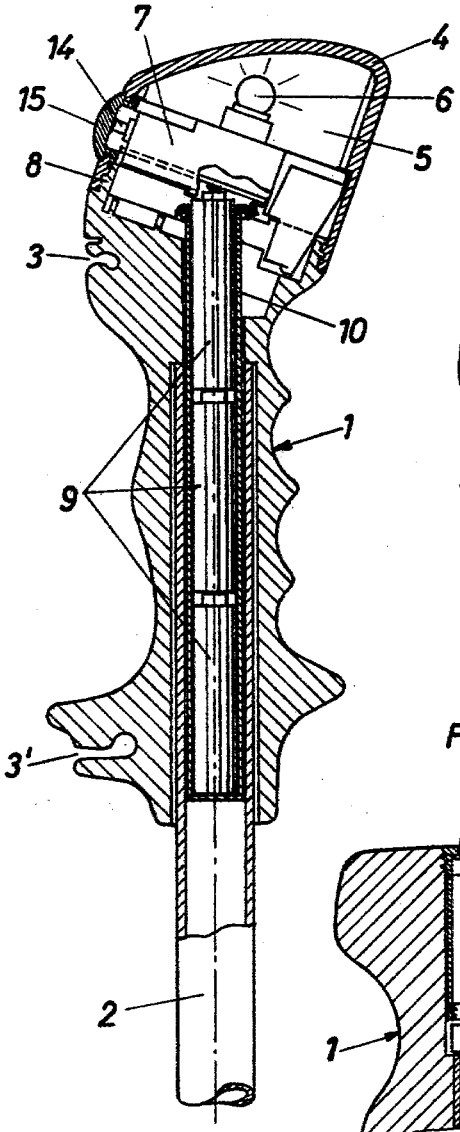
FIG. 1 is a longitudinal section through one embodiment of a ski-stick handle connected to the upper end of a ski-stick shaft.

A ski-stick handle 1, which may be of any desired shape, is mounted in conventional manner on one end of a ski-stick shaft 2 whilst a ski-plate is mounted on the other end.

In the illustrated example the handle 1 is a so-called safety handle which is adapted to the shape of the hand which is to grip it and is provided with connecting elements 3 and 3' for a safety strap or loop (not shown).

A compartment 5 is provided in the upper part of the handle 1 and is closable and partly delimited by a translucent or transparent detachable cover 4 for light bulb 6. The bulb 6 is screwed into a component 7 containing an electronic control or a control device suitable for producing the required type of light, such as a flashing light or continuous light, and which is detachably secured to a side wall 8 and supplied with current by one or more batteries 9 inserted in a tube 10. The tube 10 is provided in the handle 1 and engages or locates in the upper end of the shaft 2 and is readily accessible upon opening the cover 4 for replacing the batteries 9.

The light of the bulb 6 shines outwards through the cover 4. The circuit of the batteries 9 is closed and opened by a pushbutton 14, which is actuable via a resilient covering 15 by the skier's finger which is closest thereto.

The bulb may shine continuously or intermittently whereby variegated light signals may be emitted. Furthermore, the switch for the light may be fitted as a pushbutton at the upper end of the handle and be actuable by the thumb of a skier.

An accumulator may be used instead of a dry-cell battery if desired. Switching may alternatively be effected by a rotary element or a rocking lever. The handle is constructed to be protected against moisture and other harmful weather influence.

Figure 2:
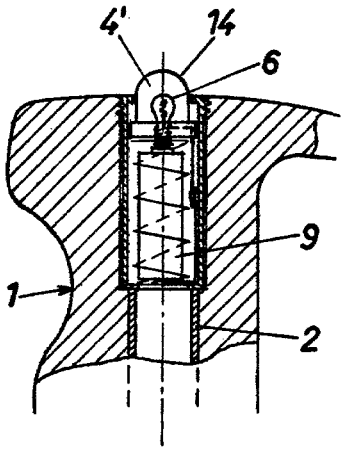
FIG. 2 is a longitudinal section through the upper end of a second embodiment of a ski-stick handle.
Figure 3:
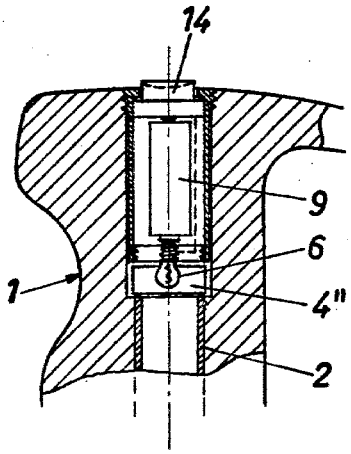
FIG. 3 is a longitudinal section through the upper end of a third embodiment of a ski-stick handle.

The embodiments of the ski-stick handle according to FIGS. 2 and 3 show signal devices which may be inserted from above e.g. screwed-in, as a complete component into a recess provided therefor at the upper end of the handle 1. In the embodiment of FIG. 2 a light is provided having an upwardly facing bulb 6 and a housing 4' which is translucent and formed as a pushbutton mechanism 14' serving for operation of the light. In FIG. 3 a similar device is provided in which, however, the light bulb 6 faces inwardly of the handle but is visible from the outside through a translucent side wall portion 4''.

What is claimed is:

1. A handle for a ski-stick comprising a wall defining a housing for accommodating in the interior thereof a light source optionally operable by an electric circuit to emit visible warning signals, a manually operable push button switch for controlling the electric circuit, and tube means for receiving an electric power source, the said light source being visible through a transparent upper portion of said wall, said upper portion being detachable to provide access to said tube means when said handle is connected to a ski-stick.

2. A handle for a ski-stick comprising a wall defining a housing for accommodating in the interior thereof a light source optionally operable by an electric circuit to emit visible warning signals, a manually operable push button switch for controlling the electric circuit, and tube means for receiving an electric power source, the said light source being visible through said wall, said tube means being positioned in a portion of the handle spaced furtherest from said ski-stick and said light source being disposed between said tube means and the ski-stick.

* * * * *